US005547199A

United States Patent [19]

Calhoun

[11] Patent Number: 5,547,199

[45] Date of Patent: Aug. 20, 1996

[54] METHOD OF PLAYING A SENTENCE FORMING GAME

[76] Inventor: Christopher A. Calhoun, 435-2 Oriana Rd., Suite 200, Newport News, Va. 23602

[21] Appl. No.: 489,557

[22] Filed: Jun. 12, 1995

[51] Int. Cl.[6] ..... A63F 1/02

[52] U.S. Cl. ..... 273/299; 273/272; 434/167

[58] Field of Search ..... 273/272, 299, 273/308, 440, 429, 430, 431, 432; 434/129, 156, 167, 322, 324

[56] References Cited

U.S. PATENT DOCUMENTS

| | | | |
|---|---|---|---|
| 422,682 | 3/1890 | Young . | |
| 1,263,664 | 4/1918 | Hanada . | |
| 1,273,864 | 7/1918 | Johnson . | |
| 1,320,817 | 11/1919 | Yost . | |
| 1,379,871 | 5/1921 | McGuire . | |
| 1,538,156 | 5/1925 | Beatty . | |
| 1,558,229 | 7/1925 | Bowman . | |
| 1,598,450 | 8/1926 | Ritter . | |
| 1,609,981 | 12/1926 | Backmeyer . | |
| 1,716,069 | 7/1929 | Loayza . | |
| 1,991,468 | 2/1935 | Schoolfield | 273/152 |
| 2,019,732 | 11/1935 | Roland | 273/152 |
| 2,189,477 | 2/1940 | Sleeth | 273/308 |
| 2,205,440 | 6/1940 | Schoenberg | 35/31 |
| 2,310,800 | 2/1943 | Manhart . | |
| 3,053,537 | 9/1962 | Moss | 273/137 |
| 3,618,231 | 11/1971 | Nason | 25/35 J |
| 3,871,115 | 3/1975 | Glass et al. | 33/35 E |
| 4,378,118 | 3/1983 | Leoarai, Jr. | 273/292 |
| 4,637,799 | 1/1987 | Bouchal | 434/236 |
| 4,671,516 | 6/1987 | Lizzola et al. | 273/299 |
| 4,684,135 | 8/1987 | Bouchal | 273/269 |
| 4,690,410 | 9/1987 | Berton | 273/299 |
| 4,948,144 | 8/1990 | Armstrong | 273/249 |
| 5,100,154 | 3/1992 | Mullins | 273/429 |
| 5,180,306 | 1/1993 | McInroy et al. | 434/129 |
| 5,190,297 | 3/1993 | Jessen et al. | 273/296 |
| 5,316,308 | 5/1994 | Stembokas | 273/440 |
| 5,375,846 | 12/1994 | Smith | 273/292 |
| 3,482,3333 | 12/1969 | Trager | 35/35 |

*Primary Examiner*—William M. Pierce

[57] ABSTRACT

A method of playing a sentence forming game is disclosed which consists of a plurality of cards with a plurality of sentences (12) known as sentence cards or sentence means (10), a plurality of cards with a plurality of pictorial elements (16) known as picture cards or picture means (14), and a plurality of rewards or scoring means (36). Players chose a sentence (12) from sentence card or sentence means (10) to form by finding relationships between words in sentence (12) on sentence card or sentence means (10) and pictorial elements (16) on picture cards or picture means (14). These relationships are subjectively judged by the other players. Players receive rewards and/or scoring means (36) based on if their explanations are subjectively judged by the other players to be interesting, creative, and/or entertaining.

20 Claims, 4 Drawing Sheets

METHOD OF PLAYING A SENTENCE FORMING GAME

BACKGROUND—FIELD OF INVENTION

This invention relates to a method of playing a card game, specifically to a method of playing a card game wherein players form sentences by relating words in sentences to pictures in an interesting, creative, and/or entertaining way.

BACKGROUND—DESCRIPTION OF PRIOR ART

There are many types of sentence forming games known. There have been several different approaches to these games. In most sentence forming games, educational games, in particular, involve the use of words on cards to be placed together to form a sentence. In U.S. Pat. No. 4,671,516 to Lizzola (1987) shows a game where a plurality of words in differing tenses are used to form sentences determined by each player. Most of these games are an exercise in using words to form grammatically correct sentences. Some known sentence forming games are used to teach players differing languages based on using cards with a pictorial representation of a particular word with choices to be made in another language. Some sentence forming games, such as U.S. Pat. No. 3,871,115 to Glass (1975), are exercises in forming sentences from pictorial representations to communicate non-verbally.

In some inventions, sentences or stories are formed based on pictorial representations set forth in some form of matrix or other set format, such as U.S. Pat. No. 4,637,799 and 4,684,135 to Bouchal (1987 and 1994, respectively).

Considering the sentence forming type games, one will generally find the type of sentences, subject of the sentence, and/or the correctness grammatically of the sentence are the primary criteria players use to play these games.

OBJECTS AND ADVANTAGES

Accordingly, several objects and advantages of the present invention are:

(a) to provide a sentence forming game that is intellectually challenging.

(b) to provide a new and novel sentence forming game which rules have been constructed in such a way to offer to the players social entertainment.

(c) to provide a new type of sentence forming game wherein a virtually unlimited number of different means can be derived of forming sentences.

(d) to provide a sentence forming game having a set of cards with a plurality of sentences on each one.

(e) to provide a sentence forming game having a set of cards with a plurality of pictorial representations on each one.

(f) to provide a new and novel sentence forming game which rules have been constructed in such a way to bring about interesting, creative, and/or entertaining ways of forming sentences through word associations, rhymes, spelling, pronunciation, definitions, synonyms and/or other types of relationships.

REFERENCE NUMERALS IN DRAWINGS

10 sentence card(s) or sentence means

Figure 1:
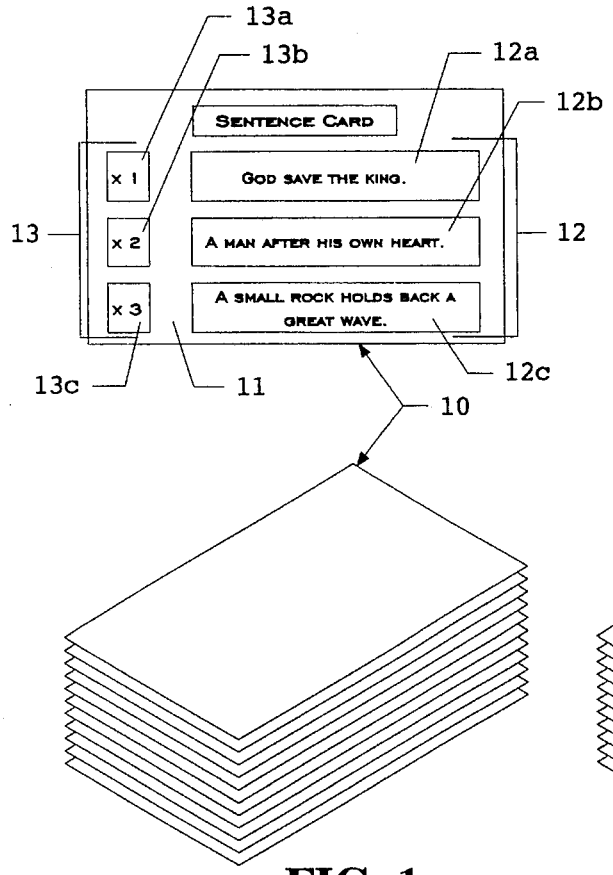
FIG. 1 is a perspective view of sentence cards or sentence means and one specific sentence card or sentence means to be used in the preferred embodiment of the present invention.

11 surface area of sentence card(s) or sentence means 10

12 sentence(s)

**12*a*** first sentence

**12*b*** second sentence

**12*c*** third sentence

13 indicia representing sentence value

**13*a*** indicia representing first sentence value

**13*b*** indicia representing second sentence value

**13*c*** indicia representing third sentence value

14 picture cards or picture means

15 surface area of picture cards or picture means 14

16 pictorial element(s)

**16*a*** pictorial element—representation of King Neptune

**16*b*** pictorial element—representation of a silhouette of a man's head

**16*c*** pictorial element—representation of a handshake

**16*d*** pictorial element—representation of a lion

**16*e*** pictorial element—representation of a shield with a heart printed on it

**16*f*** pictorial element—representation of a three-pronged staff

17 a sentence guide or display means

18 surface area of sentence guide or display means 17

19 area for displaying picture card(s) or picture means 14

20 style card(s) or style means

21 surface area of style card(s) or style means 20

22 indicia representing a specific style

23 action card(s) or action means

24 surface area of action card(s) or action means 23

25 indicia representing a specific action

26 timer device or timer means

27 rating card or rating means

28 surface area of rating card or rating means 27

29 indicia representing a specific rating

30 thumbs-up card(s) or judging favorably means

31 surface area of thumbs-up card(s) or judging favorably means 30

32 indicia representing a favorable response

33 thumbs-down card(s) or judging unfavorably means

34 surface area of thumbs-down card(s) or judging unfavorably means 33

35 indicia representing an unfavorable response

36 reward or scoring means

37 surface area of reward or scoring means 36

38 indicia representing a numerical reward

39 label or label means showing name of the preferred embodiment of method of playing sentence forming game

40 surface area of label or label means 39

41 indicia representing trademark and name of sentence forming game

DETAILED DESCRIPTION OF PREFERRED EMBODIMENT

As shown in FIG. 1 through FIG. 12, the subject invention is set forth as a system or method of playing a game using a plurality of sentence cards or sentence means 10, a plurality of picture cards or picture means 14, a plurality of sentence guides or display means 17, a plurality of style cards or style means 20, a plurality of action cards or action means 23, a timing device or timing means 26, a plurality of thumbs-up cards or judging favorably means 30, a plurality of thumbs-down cards or judging unfavorably means 33, and a plurality of reward or scoring means 36.

Referring now to FIG. 1, a perspective of a plurality of sentence cards or sentence means 10 and a specific sentence card or sentence means 10 are shown. Sentence cards or sentence means 10 may be constructed of wood, cardboard, pressed paper, metal, plastic, composition board, a computer simulated image and/or any other suitable material or shape. Sentence cards or sentence means 10 may be of any suitable material or shape provided the essential elements of the invention herein are included.

Stamped, printed, painted, or otherwise designated on surface area 11 of sentence cards or sentence means 10 has a plurality of sentences 12 with indicia 13 representing the value of sentences 12.

In the preferred embodiment, there are three sentences 12*a*, 12*b*, and 12*c* corresponding with value indicia 13*a*, 13*b*, and 13*c*.

Figure 2:
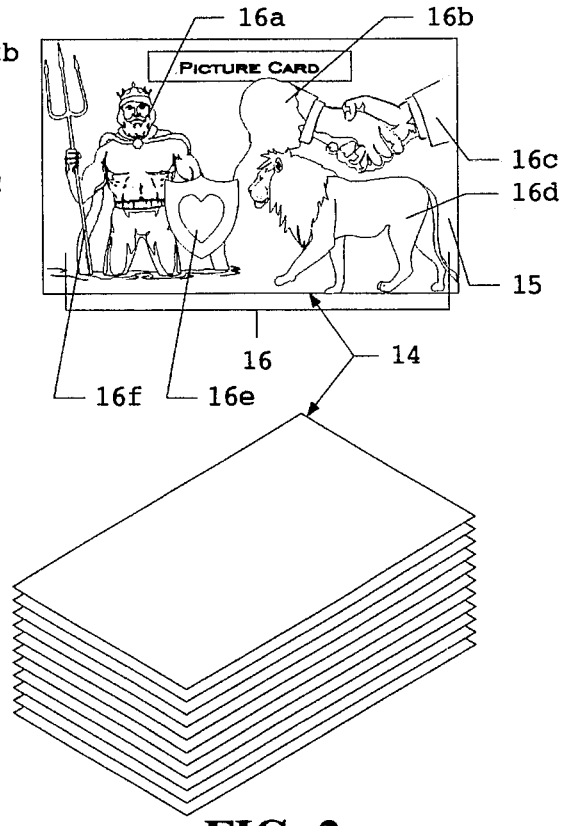
FIG. 2 is a perspective view of picture cards or picture means and one specific picture card or picture means to be used in the preferred embodiment of the present invention.

Referring now to FIG. 2, a perspective of a plurality of picture cards or picture means 14 and a specific picture card or picture means 14 are shown. Picture cards or picture means 14 may be constructed of wood, cardboard, pressed paper, metal, plastic, composition board, a computer simulated image and/or any other suitable material or shape. Picture cards or picture means 14 may be of any suitable material or shape provided the essential elements of the invention herein are included.

Stamped, printed, painted, or otherwise designated on surface area 15 of picture cards or picture means 14 has a plurality of pictorial elements 16.

In the preferred embodiment, there are no limits to the amount of pictorial elements 16 used on picture cards or picture means 14. For illustrative purposes, six specific pictorial elements are shown in FIG. 2; 16*a*, 16*b*, 16*c*, 16*d*, 16*e*, and 16*f*.

Figure 3:
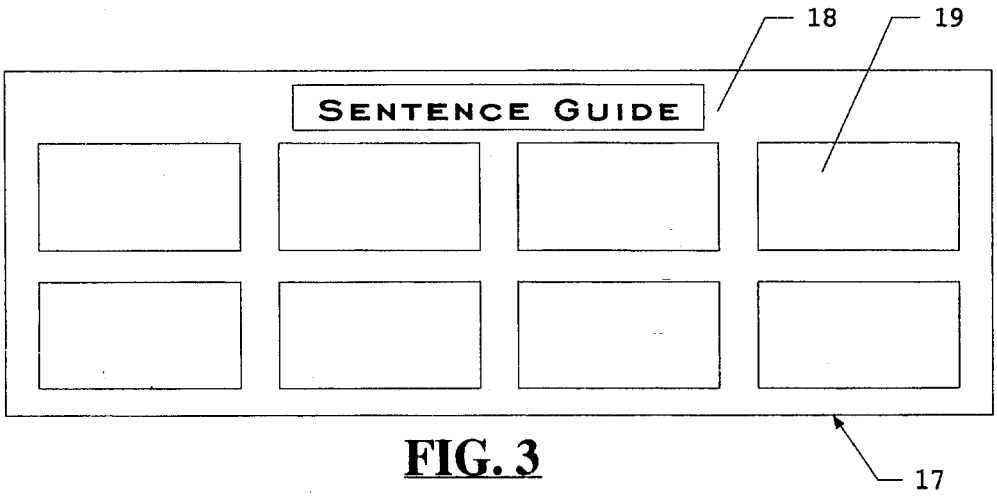
FIG. 3 is a plan view of a game board to be known as a sentence card guide or display means to be used in the preferred embodiment of the present invention.

Referring now to FIG. 3, a plan view of a sentence guide or display means 17 is shown. Sentence guides or display means 17 may be constructed of wood, cardboard, pressed paper, metal, plastic, composition board, a computer simulated image and/or any other suitable material or shape. Sentence guides or display means 17 may be of any suitable material or shape provided the essential elements of the invention herein are included.

Stamped, printed, painted, or otherwise designated on surface area 18 of sentence guides or display means 17 has a plurality of display areas 19 for picture card or picture means 14.

Figure 4:
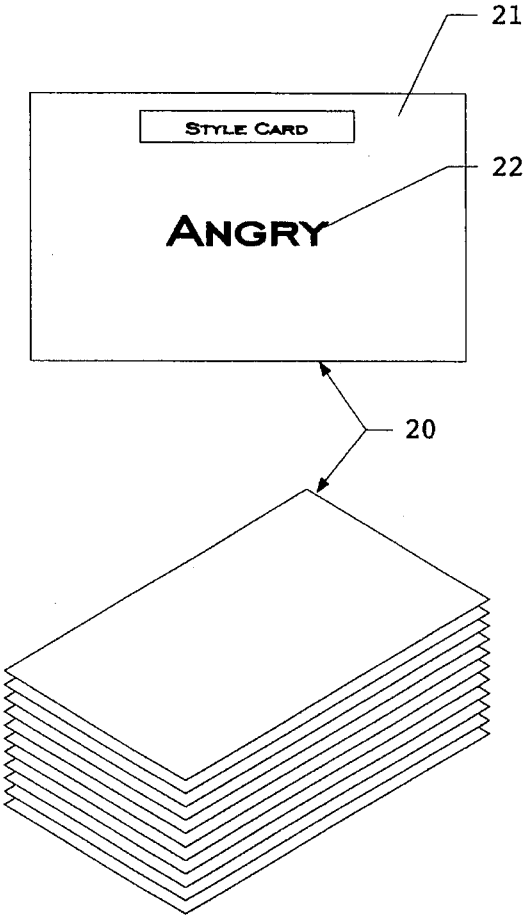
FIG. 4 is a perspective view of style cards or style means and one specific style card or style means to be used in the preferred embodiment of the present invention.

Referring now to FIG. 4, a perspective of a plurality of style cards or style means 20 and a specific style card or style means 20 are shown. Style cards or style means 20 may be constructed of wood, cardboard, pressed paper, metal, plastic, composition board, a computer simulated image and/or any other suitable material or shape. Style cards or style means 20 may be of any suitable material or shape provided the essential elements of the invention herein are included.

Stamped, printed, painted, or otherwise designated on surface area 21 of style cards or style means 20 has indicia 22 representing a specific style.

Figure 5:
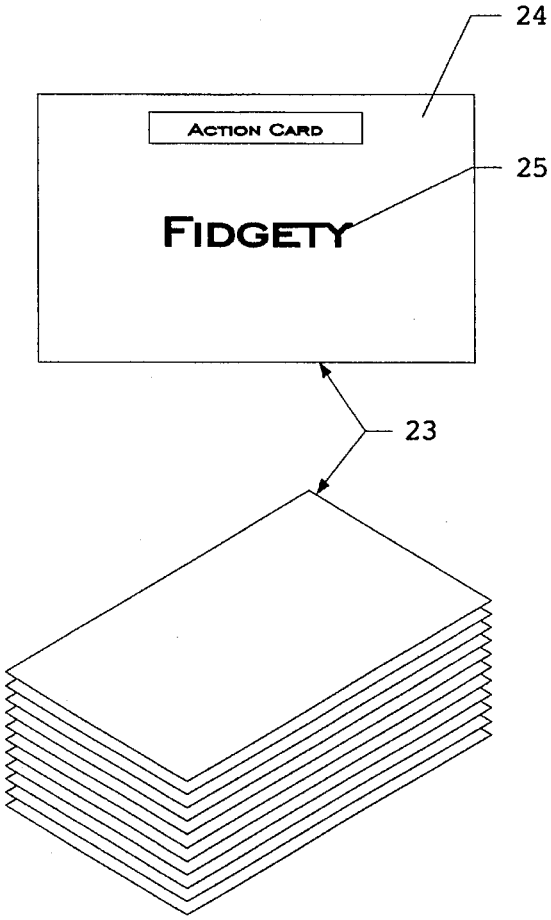
FIG. 5 is a perspective view of action cards or action means and one specific action means to be used in the preferred embodiment of the present invention.

Referring now to FIG. 5, a perspective of a plurality of action cards or action means 23 and a specific action card or action means 23 are shown. Action cards or action means 23 may be constructed of wood, cardboard, pressed paper, metal, plastic, composition board, a computer simulated image and/or any other suitable material or shape. Action cards or action means 23 may be of any suitable material or shape provided the essential elements of the invention herein are included.

Stamped, printed, painted, or otherwise designated on surface area 24 of action cards or action means 23 has indicia 25 representing a specific action.

Figure 6:
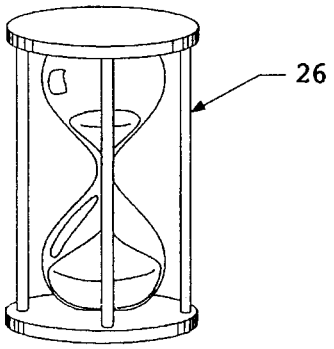
FIG. 6 is a perspective view of a timer to be used in the preferred embodiment of the present invention.

Referring now to FIG. 6, a perspective of a timing device or timing means 26. Timing device or timing means 26 may be of any suitable material or shape provided the essential elements of the invention herein are included.

Figure 7:
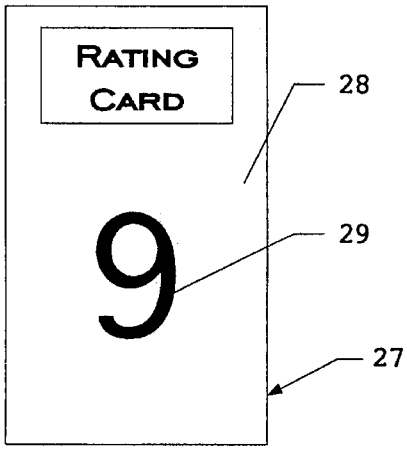
FIG. 7 is a plan view of a rating card or rating means to be used in an embodiment of the present invention.

Referring now to FIG. 7, a plan view of a specific rating card or rating means 27 is shown. Rating card or rating means 27 may be constructed of wood, cardboard, pressed paper, metal, plastic, composition board, a computer simulated image and/or any other suitable material or shape. Rating cards or rating means 27 may be of any suitable material or shape provided the essential elements of the invention herein are included.

Stamped, printed, painted, or otherwise designated on surface area 28 of rating cards or rating means 27 has indicia 29 representing a specific rating.

Figure 8:
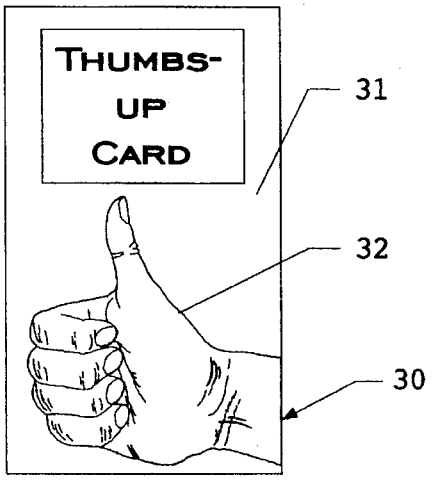
FIG. 8 is a plan view of a thumbs-up card or judging favorably means to be used in the preferred embodiment of the present invention.

Referring now to FIG. 8, a plan view of a specific thumbs-up card or judging favorably means 30 is shown. Thumbs-up card or judging favorably means 30 may be constructed of wood, cardboard, pressed paper, metal, plastic, composition board, a computer simulated image and/or any other suitable material or shape. Thumbs-up cards or judging favorably mean 30 may be of any suitable material or shape provided the essential elements of the invention herein are included.

Stamped, printed, painted, or otherwise designated on surface area 31 of thumbs-up cards or judging favorably means 30 has indicia 32 representing a favorable response.

Figure 9:
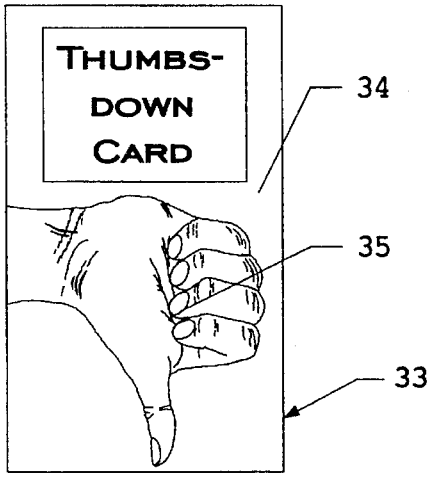
FIG. 9 is plan view of a thumbs-down card or judging unfavorably means to be used in the preferred embodiment of the present invention.

Referring now to FIG. 9, a plan view of a specific thumbs-down card or judging unfavorably means 33 is shown. Thumbs-down card or judging unfavorably means 33 may be constructed of wood, cardboard, pressed paper, metal, plastic, composition board, a computer simulated image and/or any other suitable material or shape. Thumbs-down cards or judging unfavorably means 33 may be of any suitable material or shape provided the essential elements of the invention herein are included.

Stamped, printed, painted, or otherwise designated on surface area 34 of thumbs-down cards or judging unfavorably means 33 has indicia 35 representing a unfavorable response.

Figure 10:
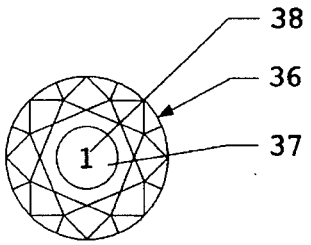
FIG. 10 is a plan view of a reward or scoring means to be used in the preferred embodiment of the present invention.

Referring now to FIG. 10, a plan view of a specific reward or scoring means 36 is shown. Reward or scoring means 36 may be constructed of wood, cardboard, pressed paper, metal, plastic, composition board, a computer simulated image and/or any other suitable material or shape. Reward or scoring means 36 may be of any suitable material or shape provided the essential elements of the invention herein are included.

Stamped, printed, painted, or otherwise designated on surface area 37 of reward or scoring means 36 has indicia 38 representing a value.

In the preferred embodiment of the present invention, a reward or scoring means 36 has indicia 38 representing the value of one multiplied by the indicia 13 of the corresponding sentences 12 formed by players.

Figure 11:
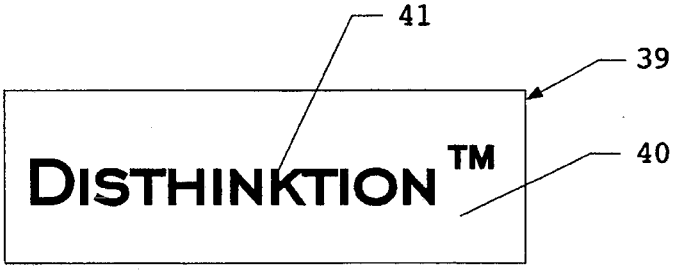
FIG. 11 is a plan view of a label bearing a trademark representing the name of the preferred embodiment of the present invention.
Figure 12:
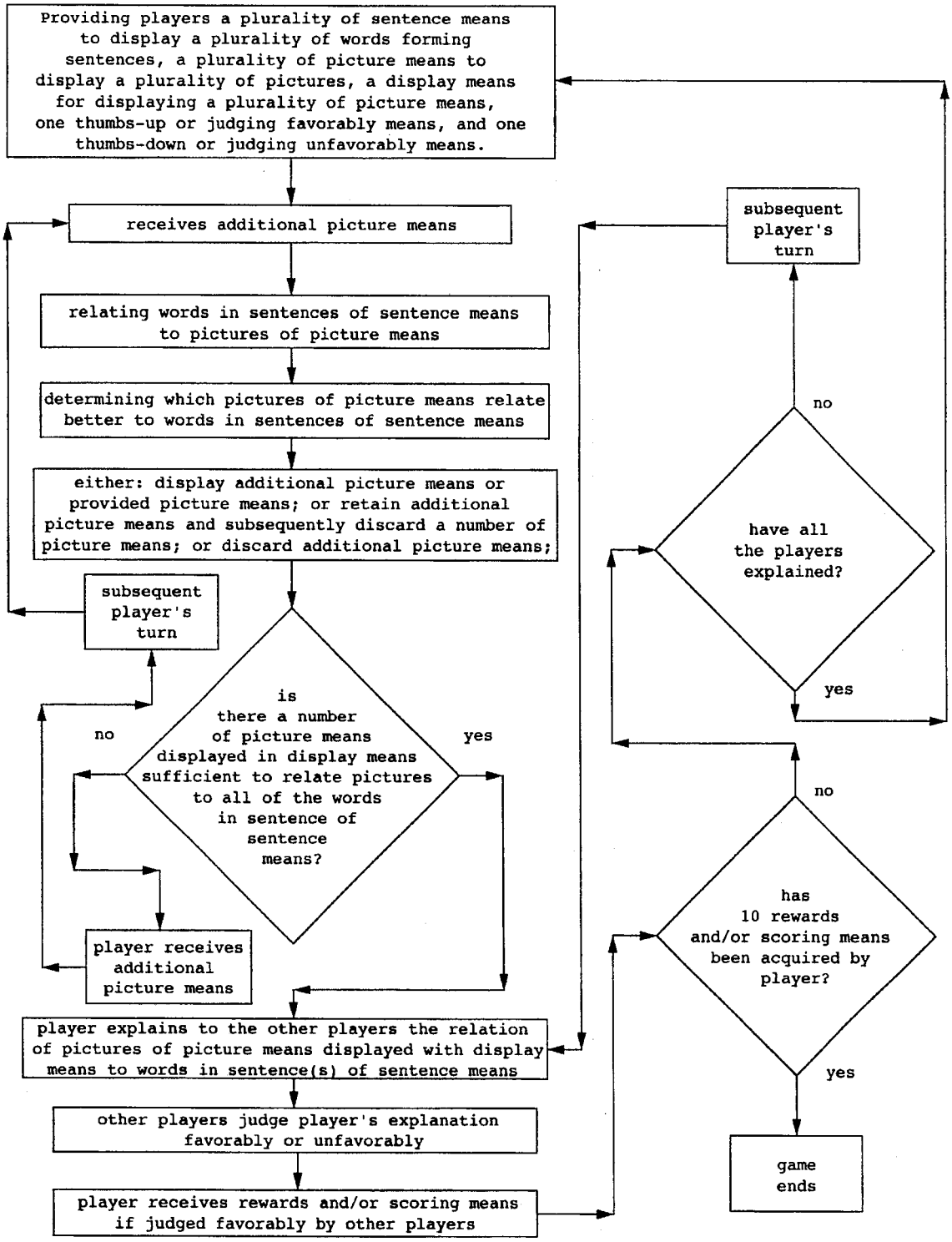
FIG. 12 is a flowchart showing the method of playing the preferred embodiment of the present invention.

Referring now to FIG. 11, a plan view of a label or label means 39 for sentence forming game's packaging or for indicating name of method of playing a sentence forming game is shown. Label or label means 39 may be constructed of wood, cardboard, pressed paper, metal, plastic, composition board, a computer simulated image and/or any other suitable material or shape. Labels or label means 39 may be of any suitable material or shape provided the essential elements of the invention herein are included.

Stamped, printed, painted, or otherwise designated on surface area 40 of labels or label means 39 has indicia 41 representing the trademarked name of the present invention.

In the preferred embodiment of the present invention, a label or label 39 has the word: Disthinktion™.

DETAILED OPERATION OF PREFERRED EMBODIMENT

Referring now to the operation of the preferred embodiment of the present invention in FIG. 1 through FIG. 12, the game or method for playing a sentence forming game begins by each player receiving one sentence card or sentence means 10, four picture cards or picture means 14, one sentence guide or display means 17, one thumbs-up card or judging favorably means 30, and one thumbs-down card or judging unfavorably means 33. The first player receives another picture card or picture means 14, decides whether received picture card or picture means 14 can relate to words in the chosen sentence 12 from sentence card or sentence means 10 in an interesting, creative, and/or entertaining way or if received picture card or picture means 14 could be related to word(s) in chosen sentence 12 easier than the four picture cards or picture means 14 already in his (or her) possession. If the received picture card or picture means 14 can be related to the words in chosen sentence 12 in an interesting, creative, and/or entertaining way, then received picture card or picture means 14 is displayed in area 19 of his (or her) sentence guide or display means 17, and then player receives another picture card or picture means 14 to end his (or her) turn. If player believes received picture cards or picture means 14 already in his (or her) possession relate to word(s) in sentence 12, then the received picture card or picture means 14 is kept and the picture card or picture means 14 which would be the hardest to relate to word(s) in chosen sentence thereby forming chosen sentence 12 in an interesting, creative, and/or entertaining way is discarded face-up and he (or she) receives another picture card or picture means 14 to end his (or her) turn. It is important to note that players may receive picture cards or picture means 14 from either the original group of picture cards or picture means 14 or from the group of discarded picture cards or picture means 14. At this point, play moves to the next player. The next player follows the previously discussed sequence. This sequence continues until one player believes he (or she) can form a chosen sentence 12 by relating the pictorial elements 16 on picture cards or picture means 14 displayed in areas 19 of sentence guide or display means 17 to words in chosen sentence 12 in an interesting, creative, and/or entertaining way. When one player displays his (or her) last picture card or picture means 14 in area 19 of sentence guide or display means 17 to finish forming chosen sentence 12, all other players stop receiving picture cards or picture means 14 and displays any or all of the picture cards or picture means 14 currently in their possession that relate to words in their chosen sentence 12 in areas 19 of their sentence guide or display means 17. The player which first attempted to form chosen sentence 12 now explains to the opposing players how the pictorial elements 16 on the picture cards or picture means 14 relate to the words that make up the chosen sentence 12. The explanation must show to the other players interesting, creative, and/or entertaining relationships between the picture elements 16 and the words that make up the chosen sentence 12 on sentence card or sentence means 10. These relationships can be based on rhymes, definitions, letters, synonyms, antonyms, metaphors, or of any other type.

Referring now to FIG. 1 and FIG. 2, the first sentence **12*a* on sentence card or sentence means 10 states: "God save the king." The player at this time would look at the pictorial elements 16 on picture card or picture means 14** and try to find relationships which would be interesting, creative, and/or entertaining to the opposing players.

One such relationship could be interpreted between King Neptune **16*a* on picture card or picture means 14 and the word "King" or the word "God" in sentence 12*a* on sentence card 10**, because King Neptune was both King of the sea as well as a God in mythology.

Another such relationship could be interpreted between shield **16*e* on picture card or picture means 14 and the word "save" in sentence 12*a*, because a shield could "save" King Neptune's 16*a*** life in the event of an attack.

For another example, suppose the player chooses to form sentence **12*b* on sentence card or sentence means 10 from pictorial elements 16 on picture card or picture means 14. Sentence 12*b* states: "A man after his own heart." The player would now look at the pictorial elements 16 on picture card or picture means 14 and try to find interesting, creative, and/or entertaining relationships between the pictorial elements 16 and the words that make up sentence 12*b***.

One interesting, creative, and/or entertaining relationship could be interpreted between the silhouette of a man's head 16*b* and the word "man" in sentence 12*b*, because it is a man's head.

Another such relationship could be interpreted between shield 16*e* on picture card or picture means 14 and the word "heart" in sentence 12*b*, because the heart on the shield 16*e*.

For a final example, suppose the player chooses to form sentence 12*c* on sentence card or sentence means 10 from pictorial elements 16 on picture card or picture means 14. Sentence 12*c* states: "A small rock holds back a great wave." The player would then look at pictorial elements 16 on picture card or picture means 14 and try to find interesting, creative, and/or entertaining relationships between the pictorial elements 16 and the words that make up sentence 12*c*.

One interesting, creative, and/or entertaining relationship could be interpreted between the eye on the lion 16*d* on picture card or picture means 14 and the word "small" in sentence 12*c*, because one could say a lion's eyes are small in proportion to the rest of the lion's body.

Another interesting, creative, and/or entertaining relationship could be interpreted between handshake 16*c* and the word "holds" in sentence 12*c*, because the two hands are holding one another.

The opposing players then decide on whether they think the player has formed their chosen sentence 12 using pictorial elements 16 from picture cards or picture means 14 in an interesting, creative, and/or entertaining way by using a thumbs-up card or judging favorably means 30 to indicate a favorable response or by displaying a thumbs-down card or judging unfavorably means 33 to indicate a unfavorable response. If a majority of the opposing players indicate a favorable response, then a number of rewards or scoring means 36 equal to 1 is multiplied by the value indicia 13 corresponding with the chosen sentence 12 and provided to that player. If a majority of the opposing players indicate a unfavorable response, then no reward(s) or scoring means 36 are given. In the preferred embodiment, the first player to accumulate ten rewards or scoring means 36 is the winner.

While the above describes the preferred embodiment of the present invention, it is intended that the scope of this invention be limited only by the appended claims. It is also intended that various steps may be moved, removed, and/or interchanged without changing the intent of the present invention. The following alternate embodiments are considered within the scope of the invention and more specifically, the claims.

The preceding preferred embodiment of the present invention: referring now to FIG. 4, wherein a set of cards to be known as style cards or style means 20 containing style type indicia 22 is performed or acted out by players while he (or she) explains how he (or she) has formed sentences 12 by relating words in sentences 12 to pictorial elements 16 on picture cards or pictorial means 14 in an interesting, creative, and/or entertaining way. The opposing players also judge the performance or acting out of emotion and/or style type indicia 22 in explanations. In this alternate embodiment, the opposing players decide on whether they think player has formed chosen sentence 12 by relating words in sentences 12 to pictorial elements 16 from picture cards or picture means 14 in an interesting, creative, and/or entertaining way and on whether player has successfully performed or acted out emotion and/or style type indicia 22 on style card or style means 20.

The preceding preferred embodiment with or without the preceding alternate embodiment of the present invention: referring now to FIG. 5, wherein a set of cards to be known as action cards or action means 23 containing action and/or movement type indicia 25 is performed or acted out by players while he (or she) explains how he (or she) formed sentences 12 by relating words in sentences 12 to pictorial elements 16 on picture cards or pictorial means 14 in an interesting, creative, and/or entertaining way. The other players also judge the performance or acting out of the action or movement type indicia 25 in explanations. In this alternate embodiment, the opposing players decide on whether they think the player has formed chosen sentence 12 by relating words in sentences 12 to pictorial elements 16 on picture cards or pictorial means 14 in an interesting, creative, and/or entertaining way and on whether player has successfully performed or acted out action and/or movement type indicia 25 on action card or action means 23.

The preceding embodiment with or without the preceding alternate embodiments: referring now to FIG. 7 wherein each player receives a set of cards to be known as rating cards or scoring means 27 containing rating type indicia 29, which is used by players in lieu of a thumbs-up card or judging favorably means 30, or thumbs-down card or judging unfavorably means 33 to indicate opposing player's opinions of player's explanations. In this alternate embodiment, the other players rate player on how successfully he (or she) has formed sentence 12 by relating words in chosen sentence 12 to pictorial elements 16 from picture cards or picture means 14 in an interesting, creative, and/or entertaining way.

The preceding preferred embodiment with or without the preceding alternate embodiments: referring now to FIG. 6 wherein a timing device or timing means 26 is used to place a time restriction on player's explanations. In this alternate embodiment, players must explain how pictorial elements 16 on picture cards or picture means 14 form a chosen sentence by relating words in chosen sentence 12 with pictorial elements 16 on picture cards or picture means 14 in a limited amount of time.

SUMMARY, RAMIFICATIONS & SCOPE

The subject invention is a sentence forming game or method of playing a sentence forming game, which comprises using a deck of cards or picture means with a plurality of pictorial elements on each one referred to as picture cards or picture means and a deck of cards or sentence means with a plurality of sentences on each one with indicia representing the sentence's corresponding value which are referred to as sentence cards or sentence means. The object of the game or method is for each player to form a chosen sentence from the sentence card they received by relating words on chosen sentence to pictorial elements from picture cards or picture means which they received in an interesting, creative, and/or entertaining way. Players choose picture cards or picture means with some form of relationship with the words in the chosen sentence from sentence card or sentence means. The relationship between the pictorial elements and the words in the chosen sentence are only limited in that the relationship should be interesting, creative, and/or entertaining to the opposing players. Opposing players decide at the end of a player's explanation of the relationship of pictorial elements to the words, if the relationships were interesting, creative, and/or entertaining. During the course of play, what relationships are allowed determine what types of relationships will be considered interesting, creative, and/or entertaining by the players. Once a certain type of relationship is agreed on, it is allowed for the other player's explanations for the duration of the game currently in progress.

While this game or method of playing a game has very few and very simple rules, the possibilities for a very intellectually challenging game exist. Like chess, this game is only as complicated as the players playing it can make it. The intellectual challenges will depend on the player's abilities to make visual, sound-like, grammatical, as well as other types of relationships between pictorial elements and words. Unlike many other sentence forming games or methods of playing sentence forming games, this invention provides a game that evokes a interesting, creative, and/or entertaining response to a simple problem of forming sentences. The relationships that players will determine are interesting, creative, and/or entertaining will change every time based on new players as well as on players becoming familiar with simple relationships, thereby pushing for the creation of new and unique relationships between pictorial elements and words.

This game provides an almost infinite range of playing possibilities. Each player will bring a different viewpoint on what types of pictorial element to word relationships are interesting, creative, and/or entertaining and as a result this will change as players learn the game or method of playing the game. As players learn the game, they will also learn about how other players communicate relationships between pictorial elements and words.

Although an illustrative embodiment of the present invention is presented here with reference to the accompanying drawings, it is to be understood that the invention is not limited to this precise embodiment and that changes and modifications may be affected therein by one skilled in the art without departing from the scope or spirit of the invention.

What is claimed is:

1. A method of playing a game comprising the steps of:

a. providing players a plurality of sentence means to display a plurality of words forming a plurality of sentences, and a plurality of picture means to display a plurality of pictures;

b. a player commencing his (or her) turn by:

i. said player relating a number of words in said sentence(s) of said sentence means to a number of pictures of a number of provided picture means;

ii. allowing said player to display a number of provided picture means;

iii. if a predetermined plurality of picture means are displayed and/or if a number of picture means sufficient to relate to a predetermined number of words in said sentence(s) of said sentence means are displayed;

(1) said player explains to the other players the relation of a number of picture(s) of a number of provided picture means displayed to a number of words in sentence(s) of said sentence means;

(2) other players judging said player's explanation of step iii.(1);

(a) if judged favorably, ending the game;

(b) if judged unfavorably, subsequent player repeats steps b–iv;

iv. if a predetermined plurality of picture means are not displayed and/or if a number of picture means sufficient to relate to a predetermined number of words in said sentence of said sentence means are not displayed, a subsequent player repeats steps b–iv.

2. The method of playing a game of claim 1 further comprising providing players a display means so as to display said picture means.

3. The method of playing a game of claim 2 wherein the picture means are cards having indicia.

4. The method of playing a game of claim 3 wherein the sentence means are cards.

5. The method of playing a game of claim 4 wherein the display means is a game board having a plurality of spaces for accommodating a plurality of said picture means.

6. A method of playing a game of claim 5 further comprising a step of: player(s) are provided a number of additional picture means; directly after step of: a player commencing his (or her) turn, but before step of: player relates a number of words in sentences of said sentence means to a number of picture means.

7. A method of playing a game of claim 6 further comprising a step of: player determines which pictures of which provided picture means relate to words in sentence(s) of said sentence means better than other provided picture means; directly after step of: a player relates a number of words in sentence(s) of said sentence means to a number of pictures of provided picture means.

8. A method of playing a game of claim 7 wherein the step of: allowing players to display a number of picture means; comprises of: allowing players to display a number of provided picture means and/or discard a number of provided picture means.

9. A method of playing a game of claim 8 wherein the step of: other player's judging said player's explanation; comprises of: other players judging said player's explanation; said player receiving a number of rewards and/or scoring means based on how well the other players judge said player's explanation.

10. A method of playing a game of claim 9 further comprising a step of: if a predetermined plurality of rewards and/or scoring means is acquired by said player, ending the game or subsequent player repeats the step of a player commencing his (or her) turn to the last step; directly after step of: said player receiving reward and/or scoring means based on how well other players judge said player's explanation.

11. A method of playing a game of claim 10 wherein the step of: if a predetermined plurality of rewards and/or scoring means is acquired by player, ending the game or subsequent player repeats steps of a player commencing his (or her) turn to the last step; comprises of: if a predetermined plurality of rewards and/or scoring means is acquired by player ending the game or a subsequent player displays a number of picture means and goes through step of explaining relationships to the last step.

12. A method of playing a game of claim 11 further comprising a step of: if all the players have completed the step of explaining without a predetermined plurality of rewards and/or scoring means acquired by a player, repeating the first step to the last step; directly after step of: if a player has acquired a predetermined number of rewards and/or scoring means, ending the game or a subsequent player displays a number of picture means and goes through step of explaining relationships to the last step.

13. A method of playing a game of claim 12 wherein the display means is any suitable surface so as to display picture means.

14. The method of playing a game of claim 12 wherein the step of: player explaining relationships further includes the step of: limiting the amount of time said player has to explain.

15. The method of playing a game of claim 14 that further includes providing a timing means.

16. The method of playing a game of claim 15 wherein the step of: other players judging player's explanation, further includes providing a plurality of rating means, the other players displaying the rating means that corresponds to how well other players judge said player's explanation.

17. The method of claim 16 wherein the rating means are cards having rating indicia.

18. The method of playing a game of claim 17 wherein the step of: explaining further includes providing a number of action(s) and/or style means having a means to display a number of action(s), style(s), movement(s), and/or emotion(s), said player acting out said action(s), style(s), movement(s), and/or emotion(s) while explaining.

19. The method of playing a game of claim 18 wherein the action and/or style means are cards having indicia.

20. A method of playing a game comprising the steps of:

a. providing players a plurality of sentence means to display a plurality of words forming a plurality of sentences, a plurality of picture means to display a plurality of pictures, and a display means for displaying a plurality of picture means;

b. a player commencing his (or her) turn by:

i. receiving additional picture means;

ii. said player relating the words in said sentence means to the pictures of said picture means provided in step a and/or to the pictures of those said additional picture means of step b.i;

iii. determining if said pictures of said additional picture means relate to said words better than pictures of said picture means provided in step a;

iv. allowing said player to: display either said additional picture means and/or said picture means provided in step a; or to retain said additional picture means and subsequently discard a number of picture means provided in step a; or to discard said additional picture means;

v. if a predetermined plurality of picture means are displayed in said display means and/or if a number of picture means sufficient to relate to all of the words in said sentence on said sentence means are displayed in said display means;

(1) said player explains to the other players the relation of pictures in picture means in said display means to a number of words in said sentences on said sentence means;

(2) other players judging said player's explanation of step v.(1);

(a) said player receives rewards and/or scoring means based on how well other players judge explanation of step v.(1);

(b) if a predetermined plurality of rewards and/or scoring means is acquired by said player ending the game or a subsequent player displays provided picture means and/or said additional picture means in display means and repeats steps (1)–vi;

(c) if all the players have explained in step (1) without a predetermined plurality of rewards and/or scoring means acquired by a player, repeating steps a–vi;

vi. if a predetermined plurality of picture means are not displayed and/or if a number of picture means sufficient to relate to all of the words in said sentence on said sentence means are not displayed in said display means, a subsequent player repeats steps b–vi.

* * * * *